United States Patent [19]

Carver

[11] 4,154,384

[45] May 15, 1979

[54] LATCH HOOKING YARN DISPENSER

[76] Inventor: Juanita Carver, 6255 E. Avalon, Scottsdale, Ariz. 85251

[21] Appl. No.: 762,357

[22] Filed: Jan. 25, 1977

[51] Int. Cl.[2] ..... B65D 71/00; A45C 11/00

[52] U.S. Cl. ..... 224/45 P; 211/49 D; 206/409; 206/391

[58] Field of Search ..... 224/45 P, 45 T, 45 R; 223/106, 107; 211/74, 13, 490, 113; 248/339, 340; 206/409, 391, 64; 221/210, 213

[56] References Cited

U.S. PATENT DOCUMENTS

| | | | |
|---|---|---|---|
| 70,825 | 11/1867 | Fletcher | 223/107 |
| 149,720 | 4/1874 | Chase | 223/106 |
| 191,914 | 6/1877 | Beausoleil | 223/106 |
| 547,736 | 10/1895 | Notkin | 223/107 X |
| 1,279,520 | 9/1918 | Deason | 223/106 |
| 1,323,405 | 12/1919 | O'Bryan | 223/107 |
| 1,366,763 | 1/1921 | Berry | 224/45 P |
| 1,642,860 | 9/1927 | Lafin | 223/107 X |
| 2,245,087 | 6/1941 | Clanton | 223/107 |
| 2,340,184 | 1/1944 | Gray | 223/107 |
| 3,000,532 | 9/1961 | Miklich | 211/74 |

*Primary Examiner*—Joseph F. Peters, Jr.
*Assistant Examiner*—D. W. Underwood
*Attorney, Agent, or Firm*—Charles E. Cates

[57] ABSTRACT

A dispenser of latch hooking yarns provides a container having one or more wells for receiving a sheaf of yarn in each well and a port large enough to admit a latch hooking tool in the wall of the container communicating with the interior of each well at a point intermediate the ends of the strands of yarn disposed within the well. The strands are pulled out of the well through the container wall by means of the latch hook and the remaining strands are held in place until needed.

8 Claims, 4 Drawing Figures

LATCH HOOKING YARN DISPENSER

BACKGROUND

1. Field of Invention

This invention relates to improvements in the art of latch hooking, more particularly to the elements, construction and use of dispensers of latch hooking yarns.

2. Prior Art

Latch hooking is an enjoyable and productive hobby which enriches the spare time of a great many people. It is the art of securing a rug-like mat of strands of yarn to a flexible backing, sometimes called a canvas, made of jute or any suitable material woven or cast to provide apertures between the warp and woof of the backing. A pattern is imprinted on the backing to provide a guide for fastening the colored yarns thereto by means of a special tool that has a handle and a shank terminating in a hook. Spaced from the hook is a latch pivotally attached to the shank. To fasten the strands to the backing a short length of yarn on the order of two and one-half inches is looped over the shank behind the latch. The shank including the latch is then inserted through two adjacent holes in the backing. The ends of the yarn are looped between hook and latch and the operator engages the yarn with the hook, pulls the yarn through the hole and knots the yarn to the backing. This operation is repeated to cover the backing with yarn to make a picture and during the course of the operation a number of differing colors of yarns will be employed.

The yarns come in bundles or sheaves about two and one-half inches in diameter usually bound with plastic collars. The yarn is pulled from the collars either one at a time as used, or removed and placed within reach of the work site. In either event the yarns are loose in a short while and it becomes a problem to keep track of them when several colors are involved. The yarns become scattered, mixed and lost to the inconvenience and annoyance of the user. Moreover, if the operation is to be moved (and this is frequently desired because one can latch hook while watching T.V., talking to friends or attending meetings) it is an annoyance to gather up piles of yarn and keep the colors separated in the move.

It is therefore an object of this invention to provide means for containing the yarns in the proper assortment, and nevertheless make them easily accessible and portable, all in an inexpensive manner.

BRIEF SUMMARY OF THE INVENTION

In accordance with the present invention I have provided a container having at least one compartment sized to receive and hold a sheaf of yarn, and preferably a plurality of compartments, and an opening to the compartment giving access to the strands of yarns intermediate their ends, preferably at the midpoints, such that the latch hook can be inserted through the aperture so provided to engage a yarn length for withdrawal.

DESCRIPTION OF THE PREFERRED EMBODIMENTS

Turning now to the drawings which illustrate the presently preferred embodiments of the invention:

Figure 1:
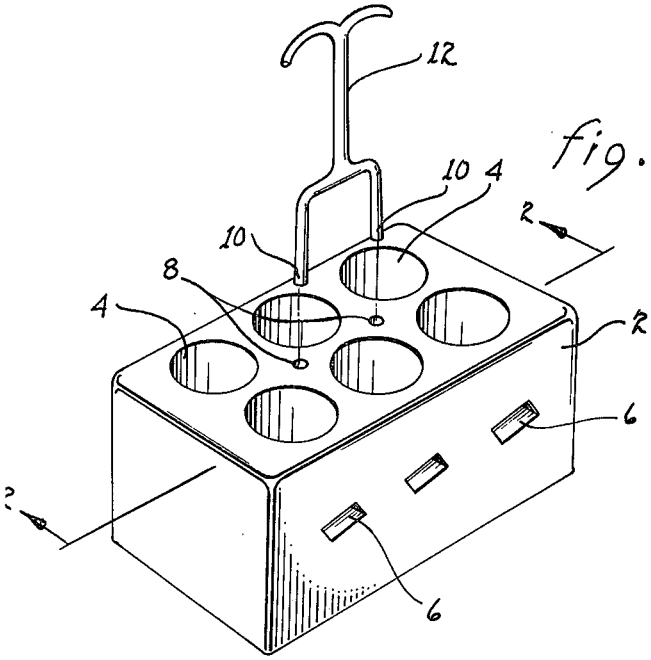
FIG. 1 is an isometric view of the invention partially exploded.

As shown in FIG. 1, a container 2 is constructed of a suitable plastic such as polystyrene. Although it is to be understood that the dimensions are not critical a useful size for containers has been determined to be 9 1/16 inches by 6 2/16 inches on sides A and B respectively by 2½ inches on side C. Conveniently the diameter of the wells 4 is 2⅝ inches. These accommodate the standard sheath of latch hooking yarn which measures approximately 2½ inches in diameter. The wells may be molded in the container or they may be routed after the block of plastic is cast. The side ports 6 and the holes 8 provided for the reception of the ends 10 of the hanger 12 are conveniently bored after the container is cast. The ports 6 are elongate slots disposed at an angle to the axis of the well 4. The hanger 12 is optional and is not an essential element of the invention.

Figure 2:
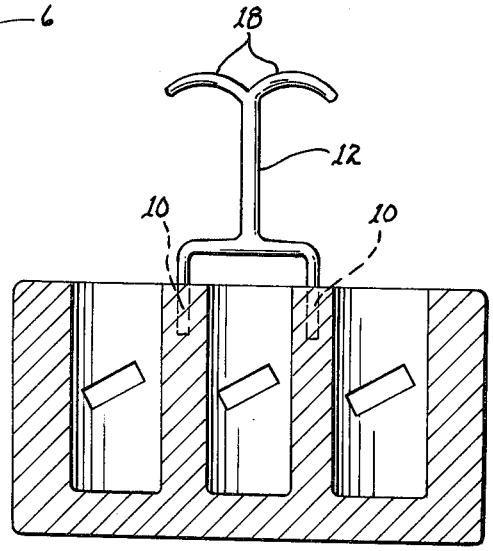
FIG. 2 is a view of the device of FIG. 1, in section along the lines 2—2.

In FIG. 2 the preferred embodiment which was shown in exploded form in FIG. 1 is shown with the hanger 12 inserted. The ends 10 of the hanger 12 are glued into holes 8 drilled in the top surface 16 of the container 2. In this preferred embodiment the hanger 12 has curving handles 18 which are adapted to serve as hooks for hanging the container on table edges, chairs and other places near the operator's work area.

Figure 3:
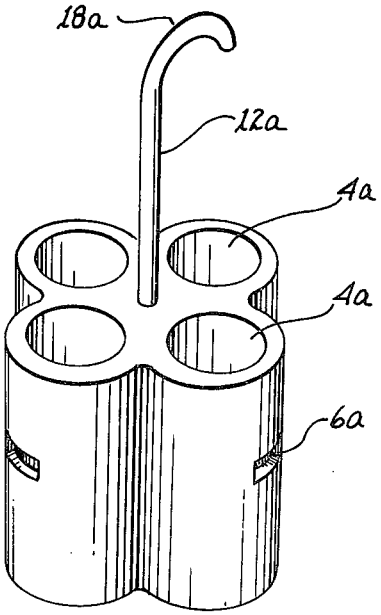
FIG. 3 is an isometric view of an alternative embodiment.
Figure 4:
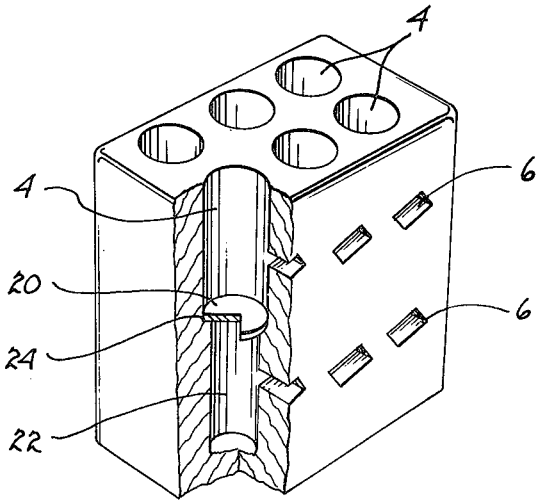
FIG. 4 is an isometric view of yet another alternative embodiment.

FIG. 3 shows an optional embodiment wherein the side ports **6*a* are horizontal and the hanger 12*a* has one handle 18*a*. In this embodiment the wells 4*a* are clustered concentrically around the hanger 12. The number and shapes of the wells may be varied. Also the shapes and numbers of the ports may be varied according to need. The size and shape of the ports 6, 6*a*** should be large enough to gain access to the interior with the hook but not so large as to permit the yarn to bulge out; otherwise size is not critical. The proper dimensions can be ascertained for a particular embodiment without undue experimentation.

The capacity of the embodiments shown in the drawings can be doubled by making them two sheaves deep and providing ports for access to each level. In that case the lower well 22 is slightly less in diameter than well 4 creating a lip 24 that disc 20 can rest on to support the sheaves in well 4 so as to prevent a mixing of the strands. This is a matter of choice and within the spirit of the invention.

In use the wells of the dispenser are filled with strands of colored yarn which can be packed in quite firmly. The strands are withdrawn by inserting the hook of the tool through the ports in the walls of the container, hooking a strand of yarn and withdrawing it for use. The remaining strands are securely retained in the well and no risk of mixing the colors is presented.

When all but a few yarn strands have been thus withdrawn a fresh sheaf can be augmented by the remaining strands and used to refill the well.

In another embodiment in consideration of lesser expense of manufacture the means of lifting and carrying the dispenser may be a simple indentation in its ends to provide fingerholds, or the ports 6 may be used as fingerholds. The dispenser is light-weight and does not require any special provision of means for picking up and carrying it. Also as an economy measure thin-walled, hollow cylinders of plastic may be bonded endwise to flat sheets of plastic; the ports 6 can be formed in the hollow cylinder conveniently before bonding the cylinders to the sheet. However, it is felt that a more acceptable product will result from molding one of the embodiments shown.

What is claimed is:

1. A dispenser of latch hooking yarns comprising:

a. a container b. at least one yarn-holding well means formed in said container for receiving a quantity of individual yarn strands;

c. at least one port in the wall of said container communicating with the interior of said well at a point intermediate the ends of the yarn strands, said port being sufficiently large to admit the hook of a latch hook tool.

2. The container of claim 1 wherein the well means comprises a plurality of yarn holding wells.

3. The container of claim 2 wherein said wells are hollow cylinders.

4. The container of claim 2 wherein said wells accommodate two sheaves in end to end relationship.

5. The container of claim 1 having a hook-shaped handle.

6. The container of claim 5 having a double hook-shaped handle.

7. The container of claim 1 wherein said port is elongate and disposed at an angle to the axis of said well.

8. The container of claim 1 wherein the well means comprises a plurality of circular yarn-holding wells wherein said port in each well is elongate and disposed at an angle to the axis of said well.

* * * * *